US006293238B1

(12) United States Patent
Harmon

(10) Patent No.: US 6,293,238 B1
(45) Date of Patent: Sep. 25, 2001

(54) ROCKER ARM AND ROCKER ARM ASSEMBLY FOR ENGINES

(75) Inventor: Michael P. Harmon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/287,443

(22) Filed: Apr. 7, 1999

(51) Int. Cl.[7] ..... F01L 1/18; F02D 13/04

(52) U.S. Cl. ..... 123/90.16; 123/90.4; 123/90.44; 123/321

(58) Field of Search ..... 123/90.15, 90.16, 123/90.39, 90.4, 90.41, 90.42, 90.44, 320, 321, 322, 323

(56) References Cited

U.S. PATENT DOCUMENTS

| | | | |
|---|---|---|---|
| 4,497,307 | 2/1985 | Paar et al. | 123/90.33 |
| 4,656,976 | 4/1987 | Rhoads | 123/90.12 |
| 5,582,142 | 12/1996 | Neubrander | 123/90.39 |
| 5,584,267 | 12/1996 | Muir | 123/90.39 |
| 5,584,268 | 12/1996 | Natkin et al. | 123/90.46 |
| 5,596,960 | 1/1997 | Hazen | 123/90.44 |
| 5,609,133 | 3/1997 | Håkansson | 123/321 |
| 5,622,145 | 4/1997 | Hara | 123/90.16 |
| 5,632,237 | 5/1997 | Cornell et al. | 123/90.46 |
| 5,647,319 * | 7/1997 | Uehara et al. | 123/322 |
| 5,657,726 | 8/1997 | Diggs | 123/90.36 |
| 5,680,835 | 10/1997 | Ruffing et al. | 123/90.16 |
| 5,680,838 | 10/1997 | See et al. | 123/90.46 |
| 5,680,841 * | 10/1997 | Hu | 123/322 |
| 5,682,847 | 11/1997 | Hara | 123/90.16 |
| 5,701,857 | 12/1997 | Hara | 123/90.16 |
| 5,829,397 * | 11/1998 | Vorih et al. | 123/90.12 |
| 6,085,705 * | 7/2000 | Vorih | 123/90.12 |

* cited by examiner

*Primary Examiner*—Weilun Lo
(74) *Attorney, Agent, or Firm*—Marshall, O'Toole, Gerstein, Murray & Borun

(57) ABSTRACT

A rocker arm assembly for an engine is disclosed. The rocker arm assembly comprises a rocker shaft having a first side and a second side and a rocker arm pivotably disposed on the rocker shaft. The rocker arm comprises a first portion disposed on the first side of the rocker shaft for receiving a force in a first direction from a brake actuator. The rocker arm further comprises a second portion disposed on the second side of the rocker shaft for engaging a valve in a second direction opposite the first direction. When the braking mode is desired, the brake actuator forces the first portion of the rocker arm in a first direction causing the rocker arm to transfer motion from the brake actuator to the exhaust valve or valves, thereby allowing exhaust to exit the combustion chamber.

19 Claims, 4 Drawing Sheets

ROCKER ARM AND ROCKER ARM ASSEMBLY FOR ENGINES

TECHNICAL FIELD

The present invention relates generally to engine components, and more particularly to a rocker arm assembly for an engine.

BACKGROUND ART

Rocker arm assemblies for internal combustion engines and the like pivot about a fixed point, thereby displacing a valve of the internal combustion engine.

A rocker arm is ordinarily considered part of a valve train of an internal combustion engine, which is disposed within a cylinder head of the engine and also includes valves, springs and camshafts.

A rocker arm for an internal combustion engine is pivotably disposed on a rocker arm shaft and is pivoted either by a cam directly or by a pushrod in contact with the cam to open and close one or more engine valves. Often, an engine brake actuator is supplied to pivot the rocker arm one or more times during an engine cycle to cause the engine to apply braking torque to wheels of the vehicle in which the engine is used. Conventionally, the cam contacts the rocker arm on a first side of the rocker arm shaft, below the rocker arm, and the brake actuator contacts the rocker arm on a second side of the rocker arm shaft, above the rocker arm. In this arrangement, the brake actuator is located above the engine, substantially in-line with the valve, and pushes down on the rocker arm. This arrangement, however, results in an undesirable increased height and overall size of the engine assembly.

SUMMARY OF THE INVENTION

The present invention is directed to a rocker arm assembly disposed within an engine assembly and actuated in a manner which reduces the height and size of the engine assembly. Reduced engine assembly height and size means less space is required for installation and may help to reduce installation costs.

More particularly, in accordance with one aspect of the present invention, a rocker arm assembly comprises a rocker shaft and a rocker arm pivotably disposed on the rocker shaft. The rocker arm includes a first portion disposed on a first side of the rocker shaft for receiving a force in a first direction from a brake actuator. The rocker arm further includes a second portion on a second side of the rocker shaft opposite the first portion for engaging a valve in a second direction opposite the first direction.

Preferably, such a rocker arm assembly may be combined with a brake actuator in contact with the first portion of the rocker arm. The rocker arm assembly may also be combined with a first exhaust valve and a second exhaust valve in contact with the second portion of the rocker arm. When a braking mode of operation is desired, the brake actuator contacts the first portion of the rocker arm and forces the arm in a first direction, thereby causing the rocker arm to transfer motion from the brake actuator to the exhaust valve or valves of the engine.

The rocker arm may further include a central bore for receiving the rocker shaft and a second bore for receiving a roller that contacts a cam, causing the rocker arm to pivot about a pivot point, intermediate the first and second portions of the rocker arm, during normal operation of the engine.

Preferably, the rocker arm of the rocker arm assembly also includes a first section disposed on the first side of the rocker shaft for receiving the brake actuator, a second section disposed on the second side of the rocker shaft for engaging the first valve and a third section disposed on the second side of the rocker shaft for engaging the second exhaust valve.

The invention itself, together with further objects and advantages, will best be understood by reference to the following detailed description and accompanying drawings.

DESCRIPTION OF THE PREFERRED EMBODIMENT

Figure 1:
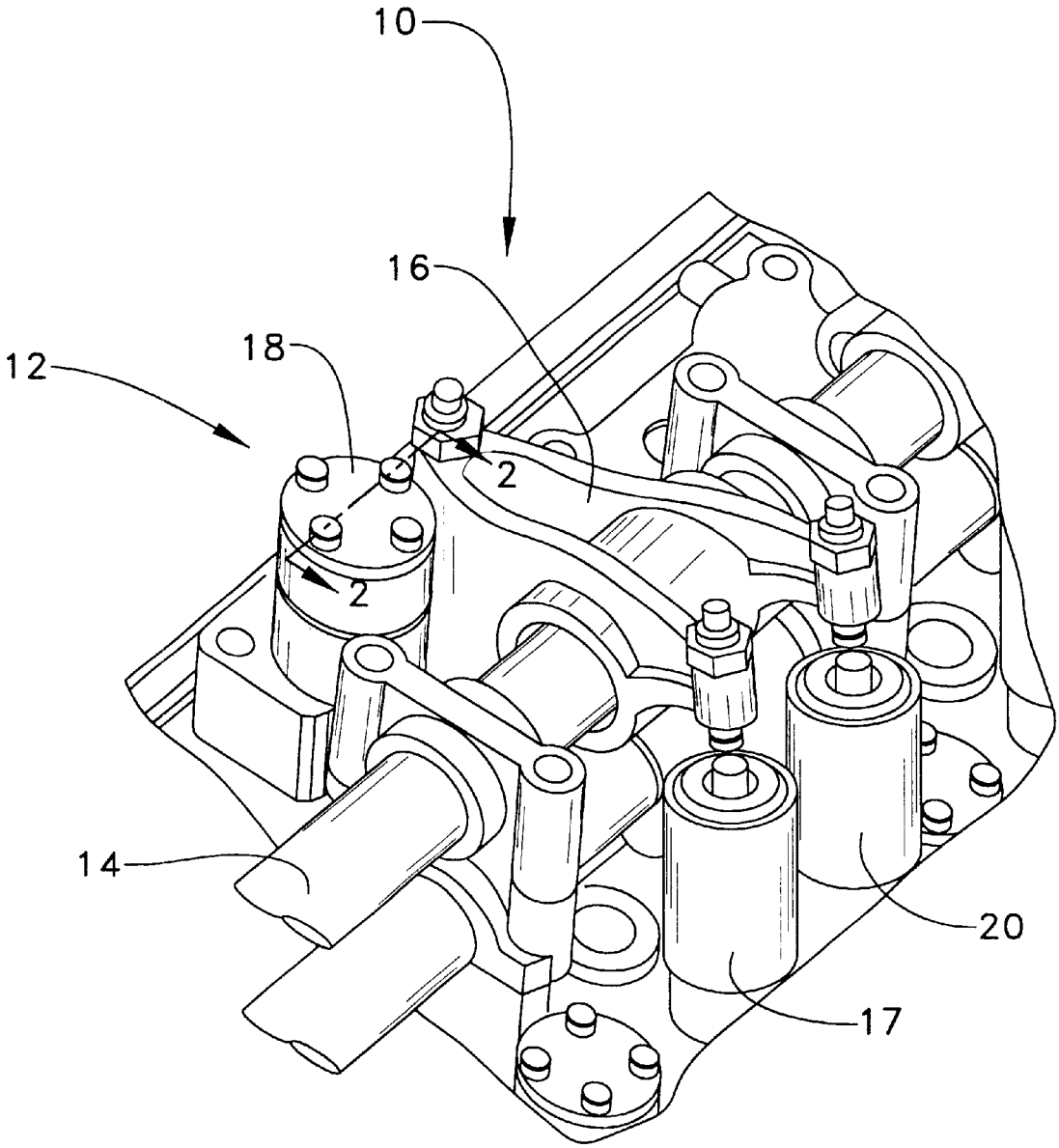
FIG. 1 is an isometric fragmentary view of an engine assembly incorporating the present invention.

Referring now to FIG. 1, a rocker arm assembly 10 constructed according to the present invention is disposed within an engine assembly 12. It should be noted that the engine assembly 12 includes a number of other such rocker arm assemblies identical to the assembly 10, such other assemblies being omitted for the sake of clarity. The rocker arm assembly 10 comprises a rocker shaft 14 and a rocker arm 16 pivotably disposed on the rocker shaft 14. As further shown in FIG. 1, a brake actuator 18, a first exhaust valve 17 and a second exhaust valve 20 are disposed inboard of the rocker arm 16, within the engine assembly 12 and below the rocker arm 16. It should be noted that more than two exhaust or other valves may be disposed inboard of the rocker arm 16.

Figure 2:
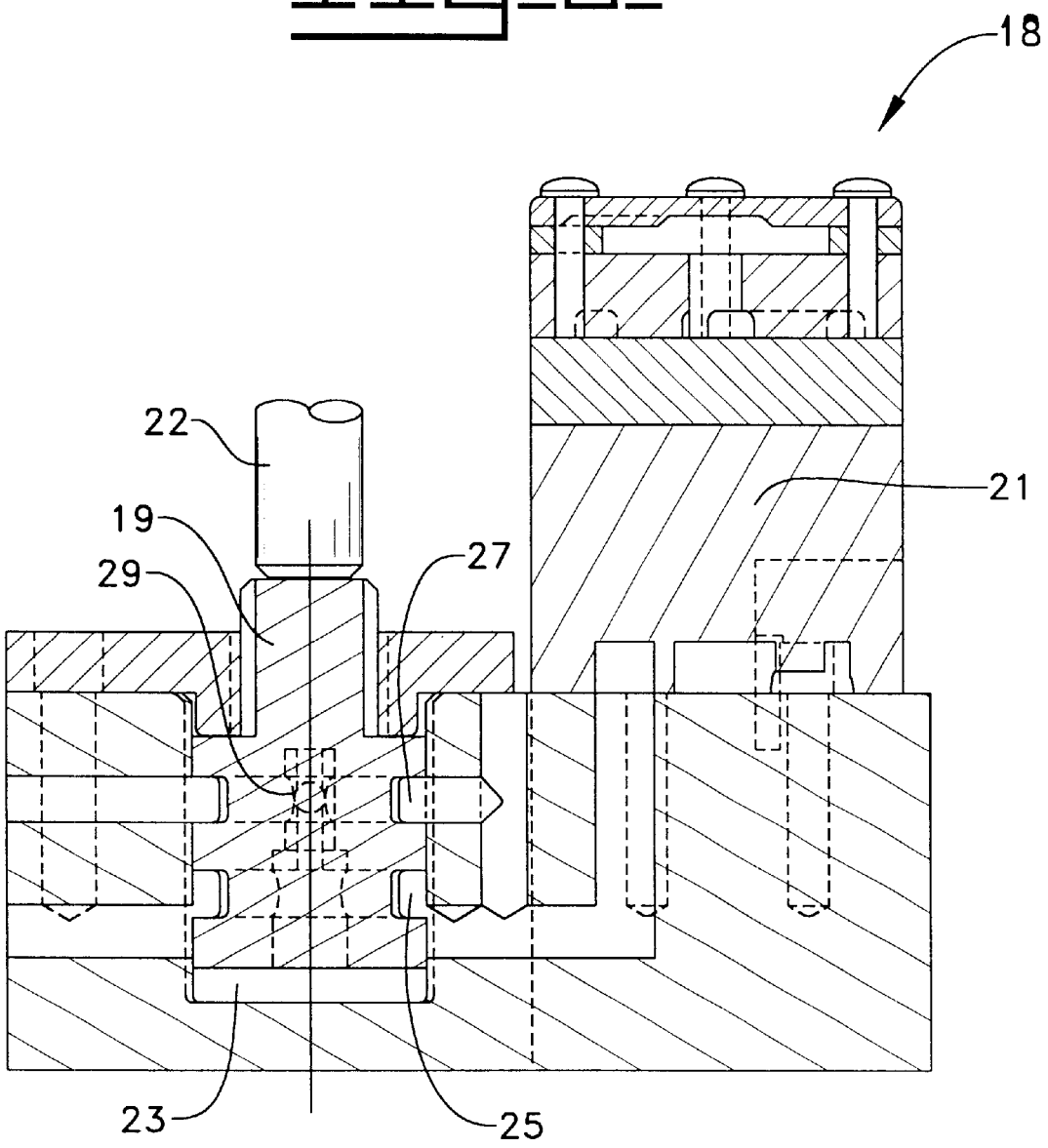
FIG. 2 is a sectional view of the brake actuator taken generally along lines 2—2 of FIG. 1.

As shown in FIG. 2, the brake actuator 18 comprises a plunger 19 and a control valve 21 that controls the flow of high pressure oil to the plunger 19. It should be noted that the control valve 21 illustrated in FIG. 2 may be replaced by any other suitable valve device including a poppet valve, spool valve, etc. During the braking mode, the brake actuator 18 typically receives a signal from an electronic control module (not shown), or other device that monitors engine operation, causing the control valve 21 to direct high pressure oil through a first annulus 25 and a second annulus 27 into a plunger cavity 23, which in turn causes the plunger 19 to move upwardly in a first direction. A ball check valve 29 remains closed during the braking mode causing the majority of high pressure oil to flow through the first annulus 25 and into the bottom of the plunger cavity 23, thereby forcing the plunger 19 to move upwardly in a first direction. When moved in the first direction, the plunger 19 contacts a first portion 22 of the rocker arm 16, as shown in FIG. 2.

When normal engine operation resumes, the ball check valve 29 opens allowing high pressure oil to escape through both the first annulus 25 and the second annulus 27 at substantially the same rate. This arrangement enables the plunger to quickly return to a normal non-braking position.

Figure 3:
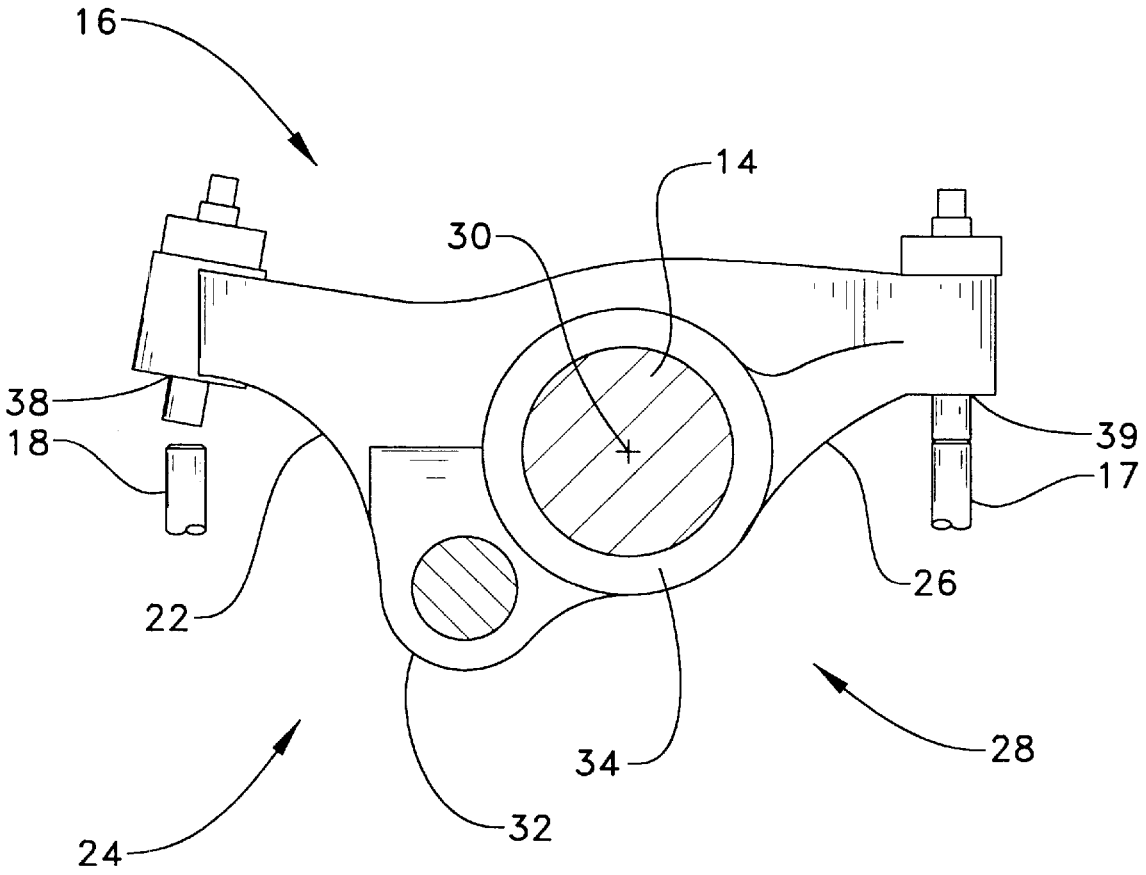
FIG. 3 is a side elevational view of a rocker arm assembly according to the present invention.
Figure 4:
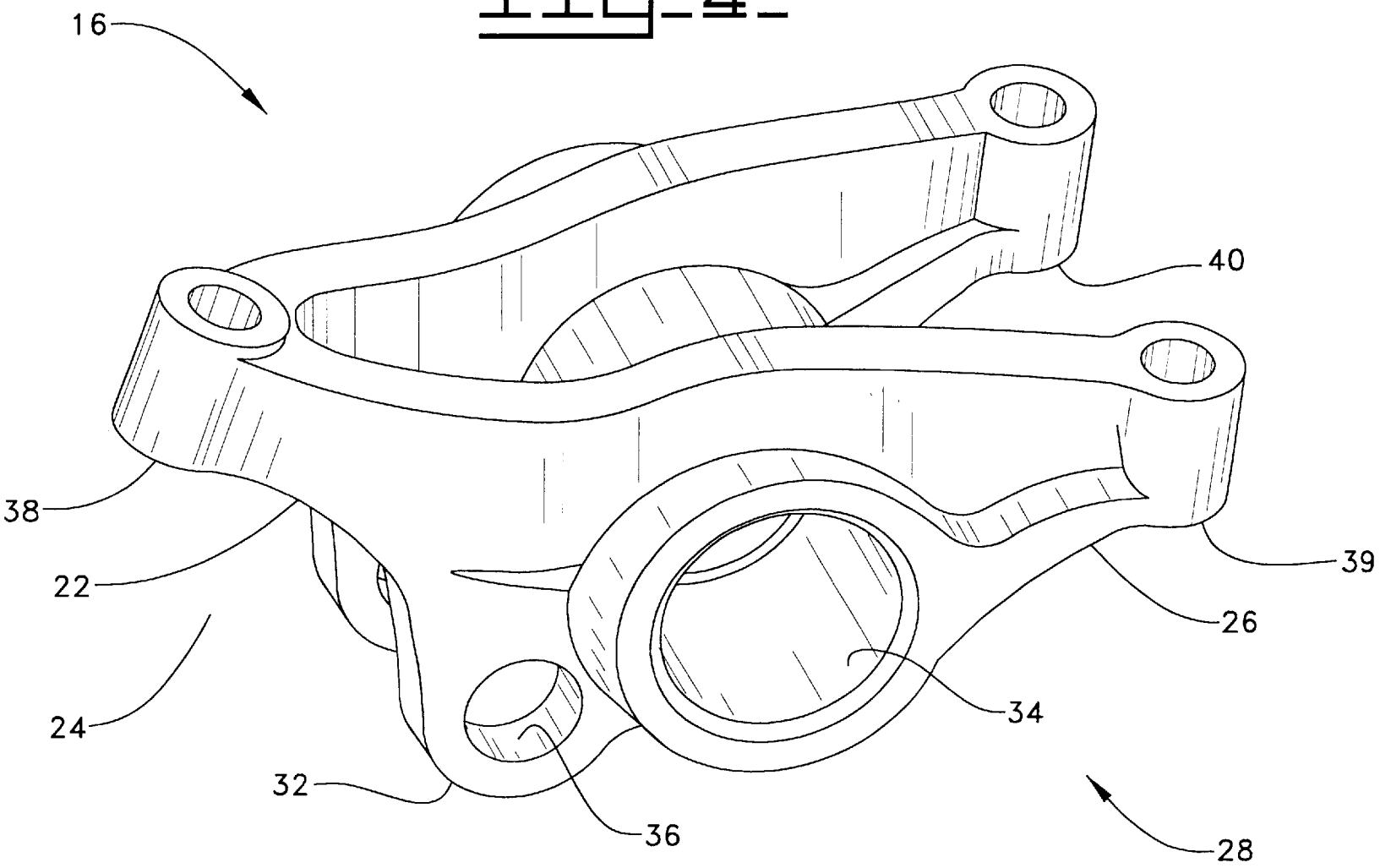
FIG. 4 is an isometric view of the rocker arm of FIG. 3.

As illustrated in FIGS. 3 and 4, the first portion 22 of the rocker arm 16 is disposed on a first side 24 of the rocker shaft 14 for receiving a force in a first direction from the brake actuator 18. The rocker arm 16 further includes a second portion 26 located on a second side 28 of the rocker shaft 14 opposite the first portion 22 for engaging the first and second exhaust valves 17, 20 in a second direction (i.e., downwardly) opposite the first direction.

The rocker arm 16 also includes a first section 38, a second section 39 and a third section 40, each of which may be partially cylindrical in shape. The first section 38 of the rocker arm 16 is for engaging the brake actuator 18 and is disposed on the first side 24 of the rocker shaft 14. The second and third sections 39,40 of the rocker arm 16 are adapted to contact the first and second valves 17, 20, respectively, and are located on the second side 28 of the rocker shaft 14 opposite the first section 38.

The rocker arm 16 also includes a central bore 34 for receiving the rocker shaft 14 and a second bore 36 for receiving a roller (not shown) that contacts a cam (not shown), as shown in FIG. 4. The roller receives the cam and rotates with the cam causing the rocker arm 16 to pivot about a pivot point 30 intermediate the first portion 22 and second portion 26 of the rocker arm during normal operation of the engine. A push rod (not shown) may also be used instead of the roller and cam to cause the rocker arm to pivot about a pivot point 30 during normal operation of the engine.

When the braking mode of the engine is desired, the control valve 21 of the brake actuator 18 receives a signal from the electronic control module (not shown) and causes the plunger 19 of the brake actuator 18 to contact the first section 38 of the rocker arm 16, forcing the first portion 22 of the rocker arm 16 in a first direction. The force is then transferred from the plunger 19 to the second portion 26 of the rocker arm 16 causing the second and third sections 39, 40 to engage the first and second exhaust valves 17, 20, respectively, thereby allowing the exhaust to exit the combustion chamber (not shown) of the engine. It should be noted that the rocker arm may engage only one valve during the braking mode. In other words, the second section 39 of the rocker arm 16 may engage only the first valve 17 or the third section 40 of the rocker arm 16 may engage only the second valve 20.

The rocker arm 16 may be manufactured by any manufacturing method known to those skilled in the art including casting, machining, powder metal pressing, forging and stamping.

Furthermore, the rocker arm 16 may be fabricated of material having varying levels of strength, such as cast iron. For example, as is known to those skilled in the art, the area around the rocker arm shaft 14 may comprise a material softer than the remainder of the rocker arm 16 in order to permit easier drilling of the central bore without a great deal of expenditure of labor.

Although the rocker arm assembly 10 is generally described herein as including a brake actuator, it is considered that any desired type of actuator or braking mechanism may be integrated into or used to actuate the rocker arm assembly according to the principles described herein.

In addition, those skilled in the art will recognize that although an electronic control module often monitors engine operation and sends a signal to the brake actuator when certain operations are desired, it is considered that any desired type of engine monitoring device or mechanism may be integrated into or used to control the different operating modes of the engine according to the principles described herein.

While the present invention has been described with reference to specific examples, the examples are intended to be illustrative only and not limiting of the invention. It will be apparent to those of ordinary skill in the art that changes, additions and/or deletions may be made to the disclosed embodiments without departing from the spirit and scope of the invention.

What is claimed is:

1. A rocker arm assembly, comprising:

a rocker shaft; and a rocker arm pivotably disposed on the rocker shaft, the rocker arm having a first portion disposed on a first side of the rocker shaft for receiving a force in a first direction from a brake actuator and a second portion disposed on a second side of the rocker shaft opposite the first portion for engaging a valve in a second direction opposite the first direction, wherein the rocker arm includes a cam driven region disposed on the first side of the rocker shaft, and wherein the cam driven region is spaced from the first portion and the second portion.

2. The rocker arm assembly of claim 1, in combination with a brake actuator in contact with the first portion of the rocker arm.

3. The rocker arm assembly of claim 1, in combination with a first exhaust valve and a second exhaust valve in contact with the second portion of the rocker arm.

4. The rocker arm assembly of claim 1, wherein the rocker arm comprises a pivot point intermediate the first portion and the second portion.

5. The rocker arm assembly of claim 1, wherein the rocker arm includes a central bore for receiving the rocker shaft.

6. The rocker arm assembly of claim 1, wherein the cam driven region includes a second bore for receiving a roller.

7. The rocker arm assembly of claim 1, wherein the rocker arm includes a first section disposed on the first side of the rocker shaft for engaging the brake actuator.

8. The rocker arm assembly of claim 7, wherein the rocker arm includes a second section disposed on the second side of the rocker shaft for engaging the first valve.

9. The rocker arm assembly of claim 8, wherein the rocker arm includes a third section disposed on the second side of the rocker shaft for engaging the second valve.

10. A rocker arm, comprising:

a first portion;

a second portion opposite the first portion;

a pivot point intermediate the first portion and the second portion;

a central bore;

a first section for engaging a brake actuator in a first direction;

a second section opposite the first section for engaging a first exhaust valve in a second direction;

a third section opposite the first section for engaging a second exhaust valve in a second direction; and a cam driven region spaced from the first section, the second section, and the third section.

11. The rocker arm of claim 10, wherein the cam driven region further comprises a second bore for receiving a roller.

12. The rocker arm of claim 10, in combination with a brake actuator in contact with the first portion of the rocker arm.

13. The rocker arm of claim 10, in combination with a first exhaust valve and a second exhaust valve in contact with the second portion of the rocker arm.

14. The rocker arm of claim 10, wherein the rocker arm is pivotably disposed on a rocker shaft having a first side and a second side opposite the first side.

15. The rocker arm of claim 14, wherein the first portion of the rocker arm is disposed on the first side of the rocker shaft.

16. The rocker shaft of claim 14, wherein the second portion of the rocker arm is disposed on the second side of the rocker shaft.

17. The rocker arm of claim 14, wherein the first section is disposed on the first side of the rocker shaft.

18. The rocker arm of claim 17, wherein the second section is disposed on the second side of the rocker shaft.

19. The rocker arm of claim 18, wherein the third section is disposed on the second side of the rocker shaft.

* * * * *